US011896110B2

(12) United States Patent
Suzuki et al.

(10) Patent No.: US 11,896,110 B2
(45) Date of Patent: Feb. 13, 2024

(54) FEED OUT CONTAINER

(71) Applicant: Shiseido Company, Ltd., Tokyo (JP)

(72) Inventors: Keiichiro Suzuki, Tokyo (JP); Xingchen Yao, Tokyo (JP); Takahiro Kishina, Tokyo (JP); Yoichi Harada, Tokyo (JP); Takahiro Kusumoto, Tokyo (JP)

(73) Assignee: Shiseido Company, Ltd., Tokyo (JP)

( * ) Notice: Subject to any disclaimer, the term of this patent is extended or adjusted under 35 U.S.C. 154(b) by 235 days.

(21) Appl. No.: 17/599,408

(22) PCT Filed: Mar. 23, 2020

(86) PCT No.: PCT/JP2020/012695
§ 371 (c)(1),
(2) Date: Sep. 28, 2021

(87) PCT Pub. No.: WO2020/203408
PCT Pub. Date: Oct. 8, 2020

(65) Prior Publication Data

US 2022/0183445 A1 Jun. 16, 2022

(30) Foreign Application Priority Data

Mar. 29, 2019 (JP) ..... 2019-065405

(51) Int. Cl.
*A45D 40/06* (2006.01)
*B65D 53/02* (2006.01)
(Continued)

(52) U.S. Cl.
CPC ..... *A45D 40/06* (2013.01); *B65D 53/02* (2013.01); *A45D 2040/0025* (2013.01); *B65D 83/0005* (2013.01)

(58) Field of Classification Search
CPC ..... A45D 40/00; A45D 40/06; A45D 40/02; A45D 40/04; A45D 40/205;
(Continued)

(56) References Cited

U.S. PATENT DOCUMENTS 5,090,744 A * 2/1992 Hagiwara ..... F16L 27/0861 285/181
5,197,814 A * 3/1993 Lombardi ..... A45D 40/06 401/98
(Continued)

FOREIGN PATENT DOCUMENTS

JP 09-121938 A 5/1997
JP 2002-370934 A 12/2002
(Continued)

*Primary Examiner* — David J Walczak
(74) *Attorney, Agent, or Firm* — Foley & Lardner LLP

(57) ABSTRACT

A feed out container includes: a metal main body outer sleeve formed as a bottomed cylinder; a metal cylindrical inner member having a first portion provided within the interior of the main body outer sleeve and a second portion that constitutes an annular protrusion; an inner plate that holds a contained material; a lid body outer sleeve formed as a bottomed cylinder; a lid body inner sleeve provided within and in close contact with the interior of the lid body outer sleeve; and a feed out mechanism that moves the inner plate in an axial direction of the sleeve to feed out the contained material. At least one of a first O ring (31) that maintains an airtight seal between the lid body outer sleeve and the inner member and a second O ring fitted about the periphery of a portion of the inner member is provided.

11 Claims, 3 Drawing Sheets

(51) Int. Cl.
*B65D 83/00* (2006.01)
*A45D 40/00* (2006.01)

(58) Field of Classification Search
CPC ..... A45D 2040/208; A45D 2040/0025; B65D 53/00; B65D 53/02; B65D 83/0005; B65D 83/0011
USPC ..... 401/68, 75–78, 98
See application file for complete search history.

(56) References Cited

U.S. PATENT DOCUMENTS

| | | | | |
|---|---|---|---|---|
| 5,860,755 | A * | 1/1999 | Bunk | A45D 40/18 132/316 |
| 5,873,667 | A | 2/1999 | Inoue et al. | |
| 5,888,004 | A | 3/1999 | Bouix | |
| 6,623,199 | B2 * | 9/2003 | Naramoto | A45C 13/008 401/98 |
| 7,086,796 | B2 * | 8/2006 | Severa | A61M 35/003 401/179 |
| 7,677,828 | B2 | 3/2010 | Tani | |
| 10,624,823 | B2 | 4/2020 | Minato et al. | |
| 2002/0015611 | A1 | 2/2002 | Blondeel et al. | |
| 2017/0135912 | A1 | 5/2017 | Perrin et al. | |
| 2019/0262242 | A1 | 8/2019 | Minato et al. | |

FOREIGN PATENT DOCUMENTS

| | | | |
|---|---|---|---|
| JP | 2005-343567 | A | 12/2005 |
| JP | 2009-136474 | A | 6/2009 |
| JP | 6147897 | B1 | 6/2017 |
| JP | 2017-518983 | A | 7/2017 |
| JP | 2017-196279 | A | 11/2017 |
| WO | WO-2018/003440 | A1 | 1/2018 |

* cited by examiner

FEED OUT CONTAINER

CROSS-REFERENCE TO RELATED APPLICATIONS

This application is a National Phase Entry of PCT International Application No. PCT/JP2020/012695 filed on Mar. 23, 2020, which claims priority under 35 U.S.C § 119(a) to Japanese Patent Application No. 2019-065405 filed on Mar. 29, 2019.

TECHNICAL FIELD

The present disclosure is related to a feed out container. More specifically, the present disclosure is related to a feed out container which has a main body portion that houses a contained material and a lid body portion to be coupled with the main body portion, and is configured to feed out the contained material from the main body portion.

BACKGROUND ART

Conventionally, a feed out container equipped with a main body outer sleeve which is formed as a cylinder with a bottom, an inner member of which a portion extends out from the main body outer sleeve, an inner plate that holds a solid contained material and is provided within the main body outer sleeve such that it is capable of moving in the axial direction of the sleeve, a lid body outer sleeve which is formed substantially as a cylinder with a bottom and defines a closed space in the interior thereof together with the main body outer sleeve, a lid body inner cylinder provided within the interior of the lid body outer sleeve, and a feed out mechanism that moves the inner plate in the axial direction of the sleeve to feed out the contained material from the inner member is known as a container for housing a solid composition such as a cosmetic for lips, as disclosed in Japanese Unexamined Patent Publication No. 2009-136474.

In the aforementioned feed out container, the main body outer sleeve, the inner member, and the lid body outer sleeve are often formed by a metal such as aluminum, to prevent volatilization of the contained material, etc. In addition, the inner member has a first portion provided within the interior of the main body outer sleeve and a second portion that extends outward from an open end of the main body outer sleeve, that is, an end surface at an open end, in many cases. At least a portion of the first portion is in close contact with the main body outer sleeve throughout the entire circumference thereof, and the second portion constitutes an annular protrusion which is adjacent to the open end of the main body outer sleeve. The lid body outer sleeve is configured such that it defines the aforementioned closed space by being in a state in which an open end thereof abuts the protrusion of the inner member (lid closed state). In addition, the lid body inner cylinder is configured such that at least a portion thereof is in close contact with the lid body outer sleeve throughout the entire circumference thereof and functions to retain the inner member, in many cases.

Meanwhile, cosmetics for lips such as lip gloss and solid lip rouge that contain a hydrocarbon such as isododecane and water are known, as disclosed in Japanese Patent No. 6147897, for example. Sale of this type of solid cosmetic for lips in an aspect in which it is housed in a feed out container in a manner similar to other cosmetics for lips is being considered.

SUMMARY

However, according to research conducted by the present inventors, it was found that in the case that a cosmetic for lips that contains a hydrocarbon such as isododecane and water is housed in a conventional feed out container, the weight of the cosmetic decreases significantly accompanying the passage of time, even if the lid body outer sleeve is coupled to the main body outer sleeve to be in a lid closed state.

The present disclosure has been developed in view of the foregoing circumstances. The present disclosure provides a feed out container which is capable of suppressing a decrease in the amount of a contained substance when the contained substance is that which contains a hydrocarbon such as isododecane and water.

A feed out container according to the present disclosure has:

- a metal main body outer sleeve formed substantially as a cylinder with a bottom;
- a metal cylindrical inner member having a first portion provided within the interior of the main body outer sleeve and a second portion that extends outward from an open end of the main body outer sleeve, at least a portion of the first portion being in close contact with the main body outer sleeve throughout the entire circumference thereof and the second portion constituting an annular protrusion adjacent to the open end of the main body outer sleeve;
- an inner plate that holds a solid contained material and is provided within the interior of the main body outer sleeve so as to be movable in an axial direction of the sleeve;
- a metal lid body outer sleeve formed substantially as a cylinder with a bottom, that defines a closed interior space with the main body outer sleeve by an end surface at an open end thereof abutting the protrusion of the inner member;
- a lid body inner sleeve provided within the interior of the lid body outer sleeve, of which at least a portion is in close contact with the lid body outer sleeve throughout the entire circumference thereof;
- a feed out mechanism that moves the inner plate in an axial direction of the sleeve to feed out the contained material from the inner member; and at least one of a first O ring fitted about the periphery of a portion of the inner member more toward a distal end thereof than the protrusion that maintains an airtight seal between the lid body outer sleeve and the inner member when the lid body outer sleeve is provided at a lid closed position, at which the lid body outer cylinder defines the closed interior space, and a second O ring fitted about the periphery of a portion of the inner member more toward a rear end than the protrusion to maintain an airtight seal between the inner member and the main body outer sleeve;
- the lid body inner sleeve being formed by a polyester series elastomer.

Note that it is desirable for both of the first O ring and the second O ring to be provided. In addition, the present disclosure is preferably applied as a feed out container that houses a solid composition that contains water and a hydrocarbon as the contained material. Specific examples of such a solid composition include cosmetics, particularly cosmetics for lips such as solid lip rouge and lip gloss.

The present inventors discovered that the significant loss of the amount of a contained material such as a cosmetic for lips in a conventional feed out container is caused by a lid body inner sleeve constituted by LLDPE (linear low density polyethylene) of the like swells by reacting with a hydrocarbon such as isododecane which is a component in the composition of the contained material such as a cosmetic for lips. That is, if the lid body inner sleeve swells, there are cases in which the lid body inner sleeve deforms in the radial direction toward the interior (toward the axis of the sleeve) or toward the exterior. A gap through which water and a hydrocarbon, which are volatile components of the contained material, may pass will be formed at a portion of the lid body inner sleeve which is deformed toward the interior in the radial direction. In addition, if the lid body inner sleeve swells, the lid body inner sleeve itself facilitates passage of the aforementioned volatile components, particularly a hydrocarbon such as isododecane, to pass therethrough.

In the feed out container of the present disclosure, the lid body inner sleeve is constituted by a polyester series elastomer based on the aforementioned new discovery. The polyester series elastomer does not swell due to hydrocarbons such as isododecane, or swells only extremely slightly. Accordingly, in the feed out container of the present disclosure, volatilization of volatile components in a contained material being facilitated due to swelling of the lid body inner sleeve is prevented. As a result, it becomes possible to effectively suppress a decrease in the amount of a contained material.

In addition, in the case that the first O ring is provided in the feed out container of the present disclosure, even if volatile components passes through the lid body inner sleeve or passes through the gap between the lid body inner sleeve and the lid body outer sleeve and proceeds toward the open end of the lid body outer sleeve, the volatile components are prevented from escaping the lid body outer sleeve by the O ring. As a result, it becomes possible to suppress a decrease in the amount of a contained material by this feature as well.

Meanwhile, there may be cases in which volatile components of a contained material held by the inner plate travel toward the side of the open end of the main body outer sleeve through a space between the main body outer sleeve and the inner member, within the interior of the main body outer sleeve. In the case that the second O ring is provided in the feed out container of the present disclosure, it becomes possible to stop the volatile components that travel in this manner. Therefore, the volatile components can be prevented from passing through the gap and escaping from the open end of the main body outer sleeve. As a result. It becomes possible to suppress a decrease in the amount of a contained material.

Cases in which the contained material includes water and a hydrocarbon as volatile components have been described above. However, the feed out container of the present disclosure is capable of preventing volatile components from escaping to the exterior of the container, thereby suppressing a decrease in the amount of the contained material, even in cases that the contained material includes volatile components other than water and a hydrocarbon.

DETAILED DESCRIPTION OF THE PREFERRED EMBODIMENTS

Figure 1:
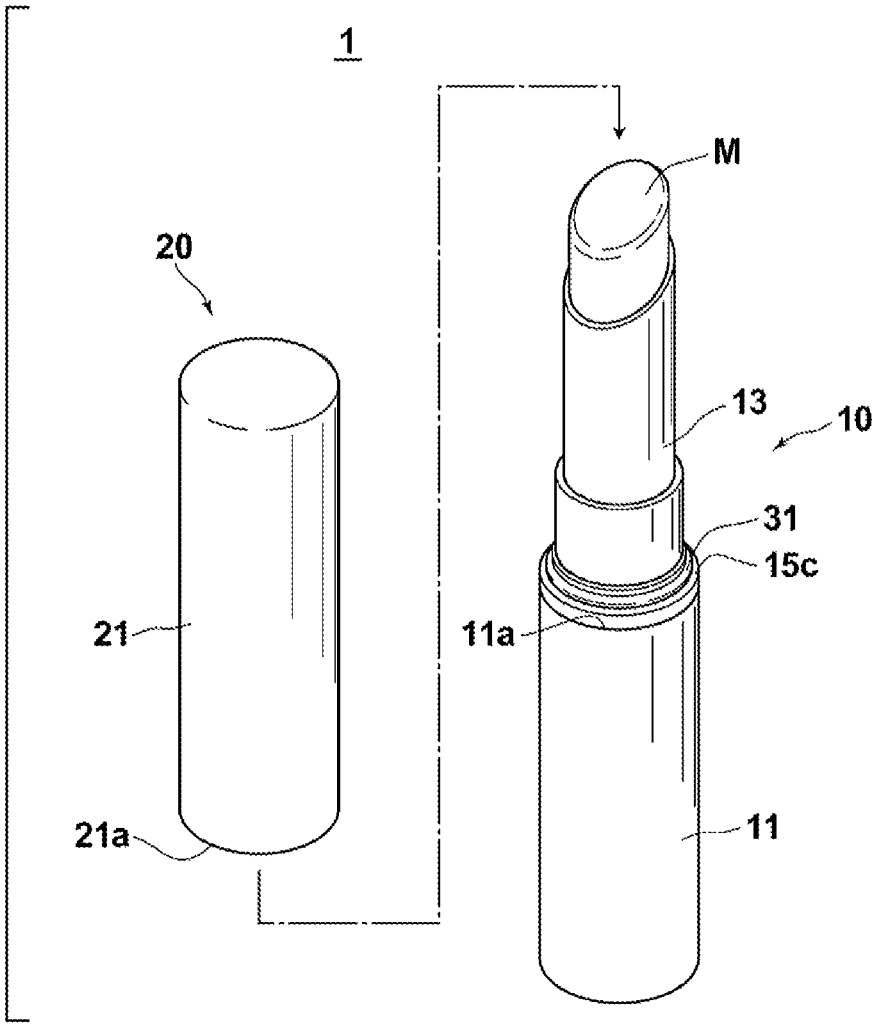
FIG. 1 is a perspective view that illustrates a feed out container according to an embodiment of the present disclosure.
Figure 2:
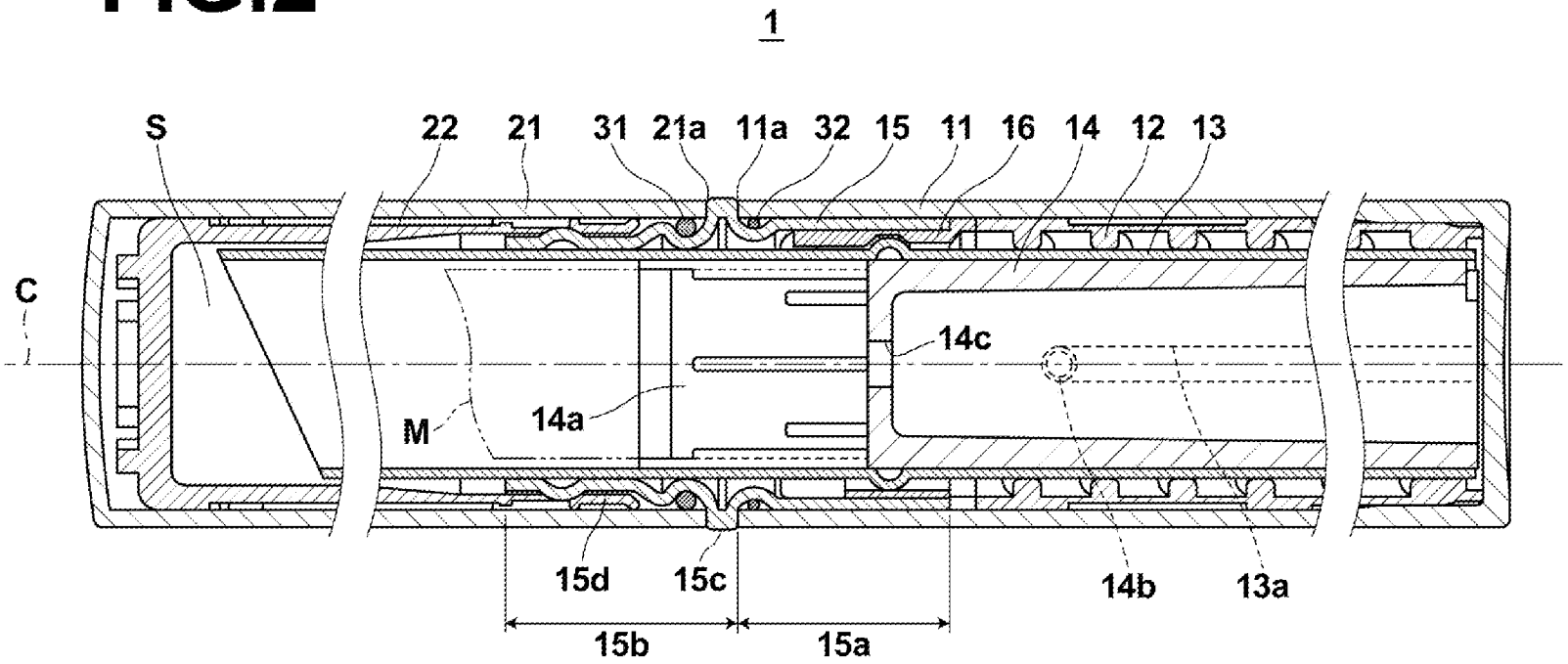
FIG. 2 is a cross sectional side view of the feed out container of FIG. 1.

Hereinafter, an embodiment of the present disclosure will be described with reference to the attached drawings. FIG. 1 is a perspective view that illustrates the outer appearance of a feed out container 1 according to an embodiment of the present disclosure, and FIG. 2 is a cross sectional side view of the feed out container 1 taken along a plane that includes the longitudinal axis thereof. As illustrated in the drawings, the feed out container 1 is constituted by a main body portion 10 that houses a contained material M, and a lid body portion 20 which is coupled with the main body portion 10 so as to cover the contained material M.

FIG. 1 illustrates a state in which the lid body portion 20 is not coupled with the main body portion 10, that is, a lid open state. Meanwhile, FIG. 2 illustrates a state in which the lid body portion 20 is coupled with the main body portion 10, that is, a lid closed state. Note that in the present embodiment, the contained material M is a cosmetic for lips, which is a solid composition that contains isododecane as a type of hydrocarbon oil component and water, for example.

The main body portion is basically constituted by: a metal main body outer sleeve 11 (skirted cylinder) formed as a cylinder with a bottom; a spiral sleeve 12 formed as a cylinder without a bottom and which is fitted into the inner circumferential surface of the main body outer sleeve 11; a rotatable sleeve 13 provided within the interior of the spiral sleeve 12 and which is relatively rotatable with respect to the spiral sleeve 12; an inner plate 14 provided within the interior of the rotatable sleeve 13 and which is capable of moving relative to the rotatable sleeve 13 in the axial direction of the sleeve; and an inner member 15 which is fitted into the inner circumferential surface of the main body outer sleeve 11 in the vicinity of an open end thereof. Meanwhile, the lid body portion 20 is basically constituted by: a metal lid body outer sleeve 21 formed as a cylinder with a bottom; and a lid body inner sleeve 22 formed as a cylinder with a bottom and which is fitted into the inner circumferential surface of the lid body outer sleeve 21.

Hereinafter, the main body portion 10 will be described in detail. The metal main body outer sleeve 11 is favorably formed employing aluminum, for example. In FIG. 2, the axis C of the sleeve is indicated by a single dotted line. The metal main body outer sleeve 11 does not allow hydrocarbon oil components such as isododecane or water to pass therethrough. This point also applies to the metal inner member 15 and the lid body outer sleeve 21 to be described later as well.

The spiral sleeve 12 in the form of a cylinder without a bottom has a spiral groove etched in the inner circumferential surface thereof, and is integrated with the main body outer sleeve 11 by being fit thereinto, for example. Two linear grooves 13*a* that extend along the axis of the rotatable sleeve 13 are formed in a peripheral wall thereof at an angular interval of 180 degrees, for example. The inner plate 14 has a housing portion 14*a* that houses the contained material M at a leading end side, that is, a side opposite the bottom of the main body outer sleeve 11. The spiral sleeve 12 and the rotatable sleeve 13 are formed by polyacetal, for example.

In addition, two protrusions 14*b* that protrude in a direction that perpendicularly intersects the axis C of the sleeve, for example, are formed on an outer peripheral surface of the inner plate 14. Each of these protrusions 14*b* passes through the linear grooves 13*a* of the rotatable sleeve 13, and are loosely engaged with the interior of the spiral groove of the spiral sleeve 12. When the rotatable sleeve 13 relatively rotates with respect to the main body outer sleeve 11, that is, with respect to the spiral sleeve 12, the inner plate 14 moves linearly within the main body outer sleeve 11 in a direction along the axis C of the sleeve. The direction of this linear movement changes according to the direction of the relative rotation.

Accordingly, by relatively rotating the rotatable sleeve 13 with respect to the spiral sleeve 12, the contained material M which is housed in the housing portion 14*a* of the inner plate 12 is fed out from the rotatable sleeve 13 (that is, from the inner member 15), or inversely returned to the interior of the rotatable sleeve 13. As described above, in the present embodiment, the spiral sleeve 12, the rotatable sleeve 13 which has the linear grooves 13*a*, and the protrusions 14*b* of the inner plate 14 constitute a feed out mechanism for feeding out the contained material M from the inner member 15.

The inner member 15 is formed by a metal, favorably by aluminum, for example. The inner member 15 has a first portion 15*a* which is provided within the interior of the main body outer sleeve 11 and a second portion 15*b* that extends outward from the open end (the end toward the opening) of the main body outer sleeve 11. The first portion 15*a* is fixed to the inner circumferential surface of the main body outer sleeve 11 by being fitted therein or the like, such that at least a portion of the first portion 15*a* is in close contact with the main body outer sleeve throughout the entire circumference thereof. Meanwhile, the second portion 15*b* constitutes an annular protrusion 15*c* which is adjacent to an open end 11*a* of the main body outer sleeve 11. Note that a holding member 16 that holds the rotatable sleeve 13 such that it is freely rotatable while preventing movement thereof in the axial direction of the sleeve is mounted in the interior of the first portion 15*a*.

A first O ring 31 is fitted about the entire periphery of a portion of the inner member 15 more toward a leading end side than the protrusion 15*c*. In addition, a second O ring 32 is fitted about a portion of the inner member 15 more toward a back end side than the protrusion 15*c*. Note that the "back end side" refers to the side of the bottom of the main body outer sleeve 11, and the "leading end side" refers to the side of the main body outer sleeve 11 opposite the bottom thereof. The first O ring 31 and the second O ring 32 are formed by nitryl rubber (NBR), for example. The second O ring 32 maintains an airtight seal between the inner member 15 and the main body outer sleeve 11.

Next the lid body portion 20 will be described in detail. The metal lid body outer sleeve 21 is favorably formed by aluminum, for example. The lid body inner sleeve 22 is formed by Hytrel (registered trademark), which is a type of thermoplastic polyester series elastomer. A portion of the lid body inner sleeve 22 in a length direction thereof is in close contact with the inner circumferential surface of the lid body outer sleeve 21 throughout the entire circumference thereof.

Next, the operative effects of the above configuration will be described. When the lid body portion 20 is coupled with the main body portion 10 such that the feed out container 1 is in a lid closed state, that is, the state which is illustrated in FIG. 2, an open end 21*a* of the lid body outer sleeve 21 abuts the protrusion 15*c* of the inner member 15, and the lid body outer sleeve forms a sealed inner space S with the main body outer sleeve 11. In the lid closed state, the lid body portion 20 achieves its intended function. That is, the contained material M which is within the sealed inner space S is isolated from the exterior of the lid body portion 20, and volatilization of the components within the contained material M is prevented.

Note that the inner member 15 is of a shape having two annular protrusions that form overhangs toward the exterior in the radial direction in the vicinity of the leading end thereof to constitute a recess 15*d*. The lid closed state is maintained by a portion of the lid body inner sleeve 22 engaging the recess 15*d* while elastically deforming. That is, the lid body inner sleeve 22 functions to retain the lid body portion 20 on the main body portion 10. It is possible to release the coupling between the lid body portion 20 and the main body portion 10 by pulling the lid body portion 20 from the main body portion 10 with a predetermined degree of force.

Prevention of volatilization of components within the contained material M will be described in greater detail. As described earlier, the contained material M is a cosmetic for lips that contains isododecane, which is a type of hydrocarbon oil component, and water. Isododecane and water (hereinafter, referred to as "volatile components") may volatilize. The aforementioned Hytrel is a material that functions well to prevent passage of these volatile components. Therefore, passage of the volatile components through the lid body inner sleeve 22 and escape of the volatile components toward the side of the open end 21*a* of the lid body outer sleeve 21 is suppressed in the lid closed state. In addition, a portion of the lid body inner sleeve 22 in the length direction thereof is in close contact with the inner circumferential surface of the lid body outer sleeve 21 throughout the entire circumference thereof. Therefore, the volatile components are also prevented from escaping toward the side of the open end 21*a* of the lid body outer sleeve 21 from a gap between the lid body outer sleeve 21 and the lid body inner sleeve 22 as well.

Further, in the lid closed state illustrated in FIG. 2, the first O ring which is fitted about the outer periphery of the inner member 15 is interposed between the inner member 15 and the lid body outer sleeve 21 and maintains an airtight seal between the inner member 15 and the lid body outer sleeve. Therefore, even if the volatile components are in a state in which they are capable of escaping toward the open end 21*a* of the lid body outer sleeve 21, the volatile components are blocked by the O ring 31, and cannot leak to the exterior of the lid body portion 20.

Note that an aperture 14*c* that operates as an air venting channel when the contained material M is housed in the inner plate 14 is formed in a portion that corresponds to the bottom of the housing portion 14*a*, as illustrated in FIG. 2. There is a possibility that the volatile components will escape through the aperture 14*c* toward an open end of the inner plate 14, move toward the side toward the inner member 15, and escape to the exterior from between the inner member 15 and the main body outer sleeve 11. Taking this possibility into consideration, the second O ring 32 is fitted about a portion of the inner member 15 more toward the back end side than the protrusion 15*c* in the present embodiment, as described previously. The second O ring 32 maintains an airtight seal between the inner member 15 and the main body outer sleeve 11. Therefore, a channel through which the volatile components may pass through is prevented from being formed between the inner member 15 and the main body outer sleeve 11.

Next, the results of an experiment that confirmed that volatilization of the volatile components was prevented will be described. The experiments employed a total of nine samples of feed out containers that include the feed out container 1 of the embodiment described above. The nine sample feed out containers were all of the same shape. The inner diameters of the main outer sleeves 11 and the lid body outer sleeves 21 were 12.1 mm, and the distances from an inner bottom surface of the main body outer sleeves 11 to an inner bottom surface of the lid body inner sleeves 22 were 77.0 mm in the lid closed state. In addition, the outer diameters of the contained materials M were 9.6 mm and the total lengths thereof were 40.7 mm in an initial state. The contained materials M were the same as that of the embodiment described above. That is, the contained materials M were cosmetics for lips that contain isododecane and water. The configurations of the principal portions of the nine sample feed out containers were as shown in Table 1 below.

TABLE 1

| Sample Number | Material of Lid Body: Outer Sleeve/ Inner Sleeve | O Rings: First O Ring | O Rings: Second O Ring |
|---|---|---|---|
| 1 | AL/LLDPE | n/a | n/a |
| 2 | AL/LLDPE | n/a | Yes |
| 3 | AL/LLDPE | Yes | n/a |
| 4 | AL/LLDPE | Yes | Yes |
| 5 | Hytrel | n/a | n/a |
| 6 | AL/Hytrel | n/a | n/a |
| 7 | AL/Hytrel | n/a | Yes |
| 8 | AL/Hytrel | Yes | n/a |
| 9 | AL/Hytrel | Yes | Yes |

In Table 1, the nine samples are respectively denoted by Sample Numbers 1 through 9. Each of the Sample Numbers are indicated as circled numbers in FIG. 3. In addition, in the Material of Lid Body column, "AL" represents aluminum, and "LLDPE" represents linear low density polyethylene, which is a material that is commonly employed as the material of a lid body inner sleeve in this type of cosmetic feed out container.

In the experiment, the feed out containers of the nine samples were placed in a static state in a 50° C. environment while maintaining a lid closed state, and how the weight of the contained materials M therein changed over time were measured. In this experiment, a feed out container which was filled with the contained material M and a feed out container which was not filled with the contained material M were prepared for each of the samples. The weight of the latter was subtracted from the weight of the former at each point in time, and the differences were designated as the weights of the contained materials M.

Figure 3:
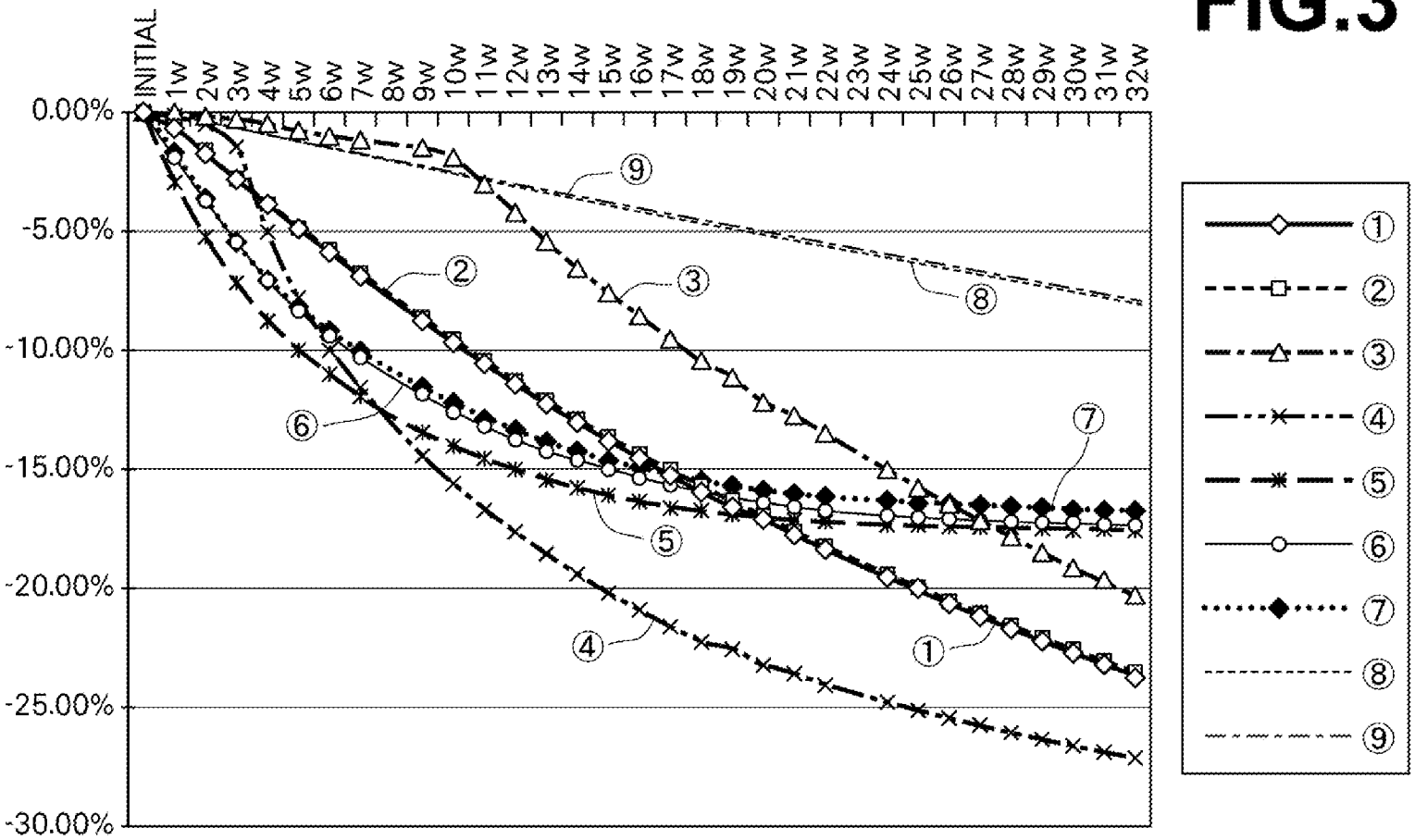
FIG. 3 is a graph that illustrates the results of an experiment that confirmed the advantageous effects of the present disclosure.

The results of this experiment are illustrated in FIG. 3. In FIG. 3, the horizontal axis represents elapsed time from an initial state in units of weeks (W), and the vertical axis represents the rate of decrease in the weights of the contained materials M from the initial state. The rates of decrease in weights indicate how many percent the weight has decreased from the initial state. For example, "−5.00%" indicates that the weight of the contained material M has decreased by 5.00% from the initial state. It can be said that volatilization of the volatile components was more positively prevented the smaller the rate of decrease in weight is.

The measurement results of FIG. 3 will be considered. Sample 9, which is the feed out container 1 according to the embodiment described above, had the most gradual progression of the decrease in the amount of the contained material over time. The rate of decrease in the weight of the contained material at a point in time at which 32 weeks had elapsed from the initial state (hereinafter, this point in time will be referred to as "final point in time"), is the smallest among all of the nine samples. Sample 8, which differs from Sample 9 only in the point that the second O ring 32 is not provided, also exhibited substantially the same contained material weight decrease property as that of Sample 9. In contrast, in Sample 7, which differs from Sample 9 only in the point that the first O ring 31 is not provided, the progression of the decrease in the amount of the contained material over time is clearly more rapid compared to Sample 9, and the rate of decrease in the weight of the contained material at the final point in time is approximately two times that of Sample 9. Based on the above, it can be said that if only one of the first O ring 31 and the second O ring 32 are to be provided, it is more desirable for the first O ring 31 to be provided.

Samples 7 through 9 described above are feed out containers according to the present disclosure. Next, the decreases in the weights of the contained materials in Samples 1 through 6, which are feed out containers outside the scope of the present disclosure, will be considered. Sample 6 differs from Sample 9 only in the point that the first O ring 31 and the second O ring 32 are not provided. Sample 6 exhibits contained material weight decrease property similar to that of Sample 7. However, the contained material weight decrease is somewhat greater at each point of time at which measurement was conducted. Sample 5 differs from Sample 9 in the point that the first O ring 31 and the second O ring 32 are not provided, and also in the point that the lid body outer sleeve 21 is formed by Hytrel, not a metal. In Sample 5, the contained material weight decrease is greater at each point of time at which measurement was conducted than Sample 6.

Samples 2, 3, and 4 respectively differ from Samples 7, 8, and 9 described above, which are feed out containers according to the present disclosure, only in the point that the lid body inner sleeve 22 is formed by LLDPE, not Hytrel. Samples 3 and 4 had a small contained material weight decrease for certain amounts of time from the initial state. However, the contained material weight decrease accelerated rapidly after approximately three weeks for Sample 4 and after approximately 10 weeks for Sample 3. The rates of decreases in weight of both Sample 3 and Sample 4 were greater than that of Sample 7 at the final point in time.

It is presumed that the rapid increase in the contained material weight decrease is due to the LLDPE, which is the material of the lid body inner sleeve 22, being caused to swell by isododecane. That is, it is presumed the swelling caused the airtight properties of the lid body inner sleeve 22 to deteriorate, and that the volatile components, particularly isododecane, passed through the lid body inner sleeve 22.

The lid body inner sleeve 22 of Sample 1 is formed by LLDPE in the same manner as Samples 2, 3, and 4 described above. Further, Sample 1 is not provided with the first O ring 31 and the second O ring 32 in the same manner as Sample 6. Sample 1 and Sample 2 exhibited substantially the same contained material weight decrease property, and the rates of decreases in weight of both of Sample 1 and Sample 2 were greater than the rate of decrease in weight of Sample 6 at the final point in time.

As described above, Samples 8 and 9, which are feed out containers according to the present disclosure, had extremely gradual decreases in weight of the contained materials throughout the entire measurement period, and the rates of decrease in weight thereof at the final point in time are clearly less than those of the other samples. In addition, Sample 7, which is a feed out container according to the present disclosure, had a more significant decrease in weight of the contained material than Sample 8 and Sample 9, but had a smaller rate of decrease in weight than any of Samples 1 through 6 at the final point in time.

Note that the feed out container 1 of the embodiment described above houses a cosmetic for lips that includes isododecante, which is a type of hydrocarbon oil component, and water as the contained material M. However, the feed out container of the present disclosure may house contained materials other than cosmetics for lips. Examples of contained materials other than cosmetics for lips include concealers and solid adhesive pastes. The present disclosure is particularly effective in the case that the contained material is a solid composition that includes water and a hydrocarbon.

Next, preferred materials for the O rings which are employed in the feed out container of the present disclosure will be described. The present inventors compared the contained material weight decrease suppressing effect, in other words, the contained material isolating effect, of nitrile rubber (NBR), which is employed in the embodiment described above, and fluorine rubber (more specifically, a vulcanized diene polyol rubber by 3M Company), by conducting an experiment. The shapes of the feed out containers which were utilized in this experiment are basically the same as that of the feed out container 1 of the embodiment described above and is illustrated in FIG. 2. However, the feed out containers which were utilized in the experiment differ from the feed out container 1 in the point that the inner members 15 thereof are formed by POM (polyacetal), not aluminum, as shown in Table 2 below. In addition, the lid body outer sleeves 21 and the lid body inner sleeves 22 are respectively formed by aluminum and Hytrel, in the same manner as Samples 6 through 9. For the sake of comparison, feed out containers in which both the first O ring 31 and the second O ring 32 are formed by nitril rubber (hereinafter, referred to as Sample N), and feed out containers in which both the first O ring 31 and the second O ring 32 are formed by fluorine rubber (hereinafter, referred to as Sample F) were produced.

TABLE 2

| Material of Lid Body | Main Body | | |
|---|---|---|---|
| Outer Sleeve 21/ Inner Sleeve 22 | Inner Plate 15 | First O Ring 31 | Second O Ring 32 |
| AL/Hytrel | POM | NBR/Fluorine Rubber | NBR |

In the comparative experiment, nine feed out containers of Sample N which are filled with contained materials M, and nine feed out containers of Sample F which are filled with contained materials M were prepared. Three of each of the samples were placed in static states in environments at 25° C., 37° C., and 50° C., and the rates of decrease in the weights of the contained materials M were measured. Here, the contained materials M were the same as that of the embodiment described above, that is, the contained materials M were cosmetics for lips that contain isododecane and water. In addition, the measurements of the rates of decrease and the manner in which the rates of decrease are indicated are the same as those described previously. In this experiment, the rates of decrease were measured each week from an initial state until eight weeks (W) elapsed.

The results of the measurements are shown in Table 3, with the results for Sample N in the upper rows, and the results for Sample F in the lower rows. Note that in Table 3, the measurement results related to each of the conditions (ambient temperatures) are average values of each of the sets of three samples. As shown below, it can be understood that Sample F had lower rates of decrease in weight, that is, higher contained material isolating effects, than Sample N under all three conditions.

TABLE 3

| Contained Material: Cosmetic for Lips | | | | | | | | | |
|---|---|---|---|---|---|---|---|---|---|
| Condition | Initial | 1 W | 2 W | 3 W | 4 W | 5 W | 6 W | 7 W | 8 W |
| Decrease Rate of Sample N (Average Value of 3 Samples for each Condition) | | | | | | | | | |
| 25° C. | 0 | −0.04% | −0.09% | −0.1.2% | −0.17% | −0.22% | −0.24% | −0.29% | −0.33% |
| 37° C. | 0 | −0.12% | −0.26% | −0.32% | −0.42% | −0..56% | −0.63% | −0.76% | −0.89% |
| 50° C. | 0 | −0.21% | −0.52% | −0.77% | −1.07% | −1.39% | −1.55% | −1.88% | −2.22% |
| Decrease Rate of Sample F (Average Value of 3 Samples for each Condition) | | | | | | | | | |
| 25° C. | 0 | −0.01% | −0.01% | −0.02% | −0.03% | −0.04% | −0.04% | −0.06% | −0.07% |
| 37° C. | 0 | −0.06% | −0.10% | −0.13% | −0.15% | −0.19% | −0.21% | −0.21% | −0.28% |
| 50° C. | 0 | −0.04% | −0.15% | −0.18% | −0.25% | −0.30% | −0.34% | −0.34% | −0.49% |

The invention claimed is:

1. A feed out container comprising:

a metal main body outer sleeve formed as a cylinder with a bottom;

a metal cylindrical inner member having a first portion provided within an interior of the main body outer sleeve and a second portion that extends outward from an open end of the main body outer sleeve, at least a portion of the first portion being in close contact with the main body outer sleeve throughout the entire circumference thereof and the second portion constituting an annular protrusion adjacent to the open end of the main body outer sleeve;

an inner plate that holds a solid contained material and is provided within the interior of the main body outer sleeve so as to be movable in an axial direction of the sleeve;

a metal lid body outer sleeve formed as a cylinder with a bottom, that defines a closed interior space with the main body outer sleeve by an end surface at an open end thereof abutting the protrusion;

a lid body inner sleeve provided within the interior of the lid body outer sleeve, of which at least a portion is in close contact with the lid body outer sleeve throughout the entire circumference thereof;

a feed out mechanism that moves the inner plate in an axial direction of the sleeve to feed out the contained material from the inner member; and a first O ring fitted about a periphery of a portion of the inner member more toward a distal end thereof than the protrusion that maintains an airtight seal between the lid body outer sleeve and the inner member when the lid body outer sleeve is provided at a lid closed position, at which the lid body outer cylinder defines the closed interior space, and optionally a second O ring fitted about the periphery of a portion of the inner member more toward a rear end than the protrusion to maintain an airtight seal between the inner member and the main body outer sleeve;

the lid body inner sleeve being formed by a polyester series elastomer.

2. The feed out container as defined in claim 1, wherein: both of the first O ring and the second O ring are provided.

3. The feed out container as defined in claim 2, wherein: each of the first O ring and the second O ring, which is fitted about the inner member, is formed by a fluorine rubber.

4. The feed out container as defined in claim 2, wherein: the contained material is a solid composition that contains water and a hydrocarbon.

5. The feed out container as defined in claim 1, wherein: the O ring which is fitted about the inner member is formed by a fluorine rubber.

6. The feed out container as defined in claim 5, wherein: the contained material is a solid composition that contains water and a hydrocarbon.

7. The feed out container as defined in claim 1, wherein: the contained material is a solid composition that contains water and a hydrocarbon.

8. The feed out container as defined in claim 7, wherein: the solid composition is a cosmetic.

9. The feed out container as defined in claim 8, wherein: the cosmetic is a cosmetic for lips.

10. The feed out container as defined in claim 1, wherein: the inner member is of a shape having two annular protrusions that form overhangs toward an exterior in a radial direction in the vicinity of a leading end thereof to constitute a recess.

11. The feed out container as defined in claim 10, wherein: the lid closed position is maintained by a portion of the lid body inner sleeve engaging the recess while elastically deforming.

* * * * *